US005839851A

United States Patent [19]

Norfolk et al.

[11] Patent Number: 5,839,851

[45] Date of Patent: Nov. 24, 1998

[54] PERSONAL WATERCRAFT LIFT

[75] Inventors: Lynn P. Norfolk; David Charles Peterson, Jr., both of Edgewater; Ronald Price Ranere, Chesapeake Beach; Russell V. Welton, Grasonville; Martin Johnson, Crofton; John David Augustine, Laurel, all of Md.

[73] Assignee: Norfolk Fabrication, Inc., Mayo, Md.

[21] Appl. No.: 838,014

[22] Filed: Apr. 22, 1997

[51] Int. Cl.[6] ..... B63C 3/06; B63C 1/02

[52] U.S. Cl. ..... 405/3; 114/44; 405/7; 187/230

[58] Field of Search ..... 405/1, 3, 7; 114/44, 114/48; 187/227, 239, 226, 230

[56] References Cited

U.S. PATENT DOCUMENTS

| | | |
|---|---|---|
| 4,432,664 | 2/1984 | Baldyga . |
| 4,482,268 | 11/1984 | Stevenson et al. . |
| 4,641,596 | 2/1987 | Reprogle et al. . |
| 4,641,996 | 2/1987 | Seal . |
| 4,678,366 | 7/1987 | Williamson . |
| 4,686,920 | 8/1987 | Thomas . |
| 4,832,210 | 5/1989 | Wood, II . |
| 4,900,187 | 2/1990 | Uchida et al. . |
| 4,983,067 | 1/1991 | Montgomery . |
| 5,090,842 | 2/1992 | Montgomery . |
| 5,140,923 | 8/1992 | Wood . |
| 5,143,182 | 9/1992 | Basta . |
| 5,245,940 | 9/1993 | Rockwood . |
| 5,311,970 | 5/1994 | Basta . |
| 5,318,380 | 6/1994 | Murray . |

*Primary Examiner*—Dennis L. Taylor
*Attorney, Agent, or Firm*—Diller, Ramik & Wight, PC

[57] ABSTRACT

A lift is provided for a personal watercraft and includes two relatively elongated channel members each of a generally C-shaped transverse cross-section. A carriage carrying a platform upon which the personal watercraft can be supported is mounted for sliding movement between the elongated channel members through a cable, winch, reversible electric drive motor and associated gears and pulleys. When the carriage is located within the upper channel member, the latter, the platform and the personal watercraft can be swung about a vertical axes to rotate the personal watercraft between two different positions 180° removed.

29 Claims, 5 Drawing Sheets

PERSONAL WATERCRAFT LIFT

BACKGROUND OF THE INVENTION

The invention is directed to boat lifts in general and specifically to a boat lift for elevating and lowering a personal watercraft to and from a body of water adjacent a dock, boat berth, deck, walkway or similar water-adjacent structure.

Typically, a boat lift adjacent a berth or dock includes a pair of boat hull engaging rails, bunks or a similar cradle which can be elevated and lowered utilizing cables, sheaves/pulleys and associated reversible electric motors. Most often than not such boat lifts are relatively expensive to manufacture and install, cumbersome in operation and many of the parts are exposed to atmosphere which under salt water and salt air conditions is extremely corrosive shortening the expected life of most conventional boat lifts. Typical of such boat lifts are found in U.S. Pat. No. 4,686,920 granted to James L. Thomas on Aug. 18, 1987; U.S. Pat. No. 4,678,366 granted to James W. Williamson on Jul. 7, 1987; U.S. Pat. No. 4,641,996 granted to Morton M. Seal on Feb. 10, 1987; U.S. Pat. No. 4,832,210 granted to Donald M. Wood, II on May 23, 1989; U.S. Pat. No. 5,318,380 granted to Myles N. Murray on Jun. 7, 1994; U.S. Pat. No. 4,482,268 granted to Ernest W. Stevenson et al. on Nov. 13, 1984; U.S. Pat. No. 5,140,926 granted to Kevin L. Wood on Aug. 25, 1992 and U.S. Pat. No. 4,641,596 granted to Layton J. Reprogle et al. on Feb. 10, 1987.

Most recently, so-called "Personal Watercraft" (PWC) have become quite popular and are sold under such trademarks as WAVERIDER®, JET SKI®, and the like. Such personal watercraft are far lighter than a typical 17" to 35' boat, for example, which requires a relatively strong, heavy and rigid boat lift. Typically, a personal watercraft may weight 300 pounds or more and a far less sturdy lift is required which must be relatively inexpensive to manufacture, sturdy, easily installed, maintained and operated, and permit rapid elevation and lowering of a watercraft relative to water, as well as swinging the same to an adjacent dock, deck, berth or the like.

Typical lifts for such small personal watercraft reflecting some of the latter advantages are disclosed in U.S. Pat. No. 5,245,940 granted to Joseph C. Rockwood on Sep. 21, 1993; U.S. Pat. Nos. 5,311,970 and 5,143,182 granted to Samuel T. Basta on May 17, 1994 and Sep. 1, 1992, respectively; U.S. Pat. No. 4,900,187 granted to Jack Uchida et al. on Feb. 13, 1990; U.S. Pat. Nos. 4,983,067 and 5,090,842 granted to David M. Montgomery on Jan. 8, 1991 and Feb. 25, 192, respectively; and U.S. Pat. No. 4,432,664 granted to Joseph W. Baldyga on Feb. 21, 1984.

SUMMARY OF THE INVENTION

The invention provides a novel lift, particularly for a personal watercraft, which is constructed from a minimum number of parts which can be fabricated and assembled relatively quickly, reliably and inexpensively and when thus assembled the lift can be similarly quickly and inexpensively installed adjacent an associated deck, dock or berth. The watercraft lift utilizes a minimum number of parts and most are protected from atmosphere and the corrosive effects thereof, particularly when the lift is subject to saltwater and salt air conditions and the known corrosive effects thereof.

The specifics of the watercraft lift include an upper relatively elongated member and a lower relatively elongated member both being of substantially identical C-shaped cross-sectional configurations having longitudinal axes which are aligned in one position for lifting and lowering, yet can be rotated to offset parallel positions to swing a cantilevered horizontal watercraft support platform and an associated watercraft thereon between positions 180° removed from each other and locked thereat. Thus, the watercraft can not only be lifted and lowered with respect to a body of water, but it can bed swung while its in its elevated position above the water into overlying relationship to an associated dock, berth or the like and locked in such position to facilitate watercraft loading, unloading, maintenance, repair, etc. The cantilevered platform or support can also be locked in its elevated position above the water which assures that high winds or other outside influences cannot inadvertently or accidentally cause platform movement which in turn could damage the watercraft or adjacent equipment/personnel.

The cantilevered horizontal watercraft support or platform is rigidly welded to a carriage having rollers, and the carriage is winched by a cable between elevated and lowered positions. The carriage rollers are guided along front flanges and a bight wall of the upper and lower elongated members to assure error-free accent and descent of the carriage, its associated platform and the watercraft thereupon. The carriage is essentially totally housed within the confines of the upper and lower elongated members and is thus less subject to adverse effects caused by the environment (saltwater and salt air). However, more important is the fact that both the carriage and its associated cable are essentially entirely housed for movement within the elongated members, thus preventing inadvertent damage to personnel, as might otherwise occur if these components were exteriorly located.

The power source for elevating and lowering the carriage, the cantilevered watercraft platform and the watercraft supported thereon is an electric motor which through a drive belt, pulleys/sheaves and gears imparts selective up-and-down motion to the carriage. The latter components are preferably housed in a polymeric/copolymeric cover or housing atop an uppermost portion of the upper elongated member thereby protecting these moving components and the motor from atmospheric conditions (saltwater/salt air) which again assures relatively long maintenance-free operation of the watercraft lift.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
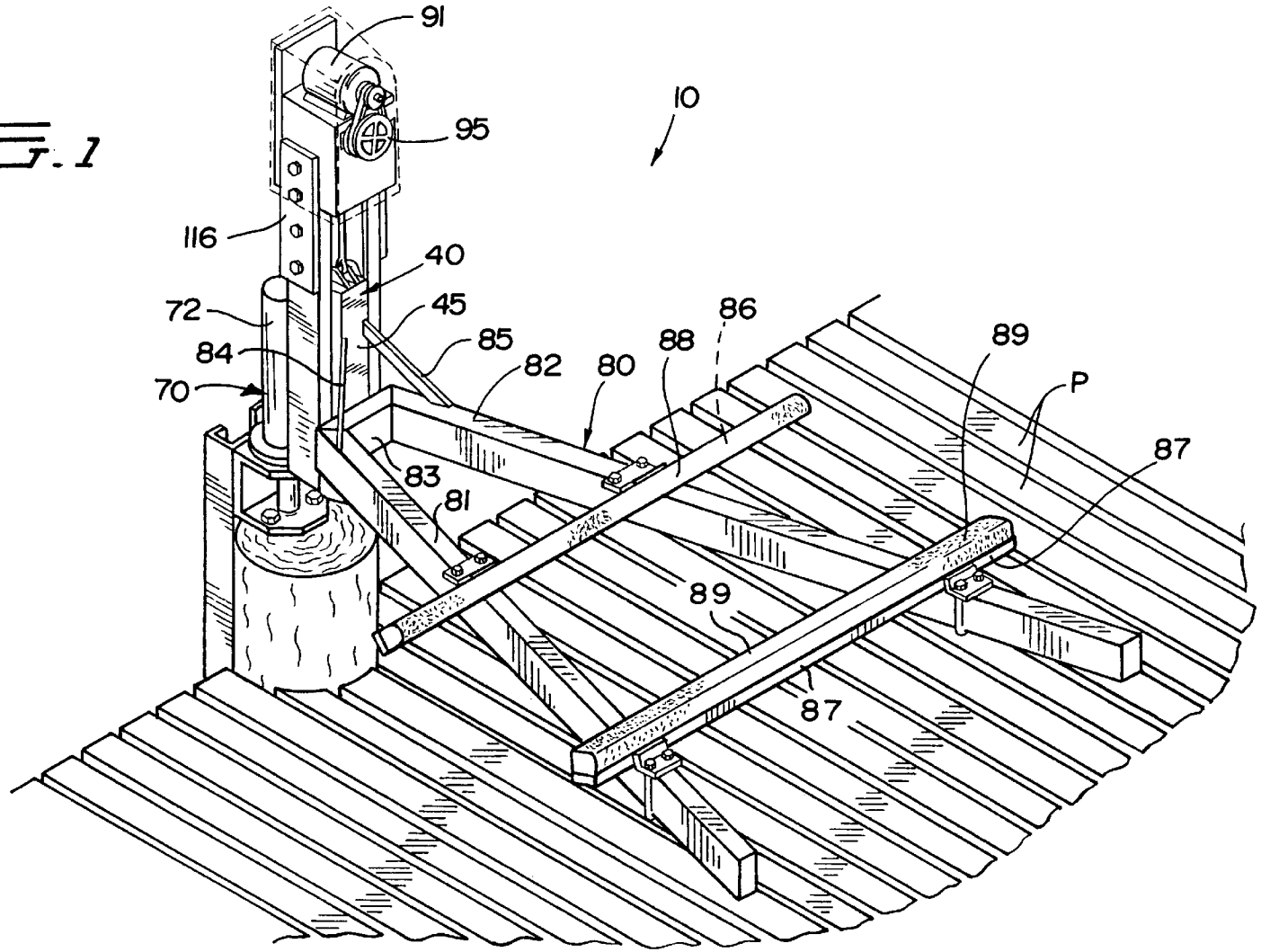
FIG. 1 is a perspective view of a novel personal watercraft lift of the present invention, and illustrates a cantilevered watercraft support or platform overlying an adjacent dock in which position a personal watercraft can be loaded upon bunks/rails of the platform for rotational movement about a vertical axis and subsequent descent into adjacent water.

A novel personal watercraft lift adapted to selectively elevate and lower a personal watercraft PWC or like object and effect rotational displacement thereof when in an elevated position is generally designated by the reference numeral 10.

Figure 2:
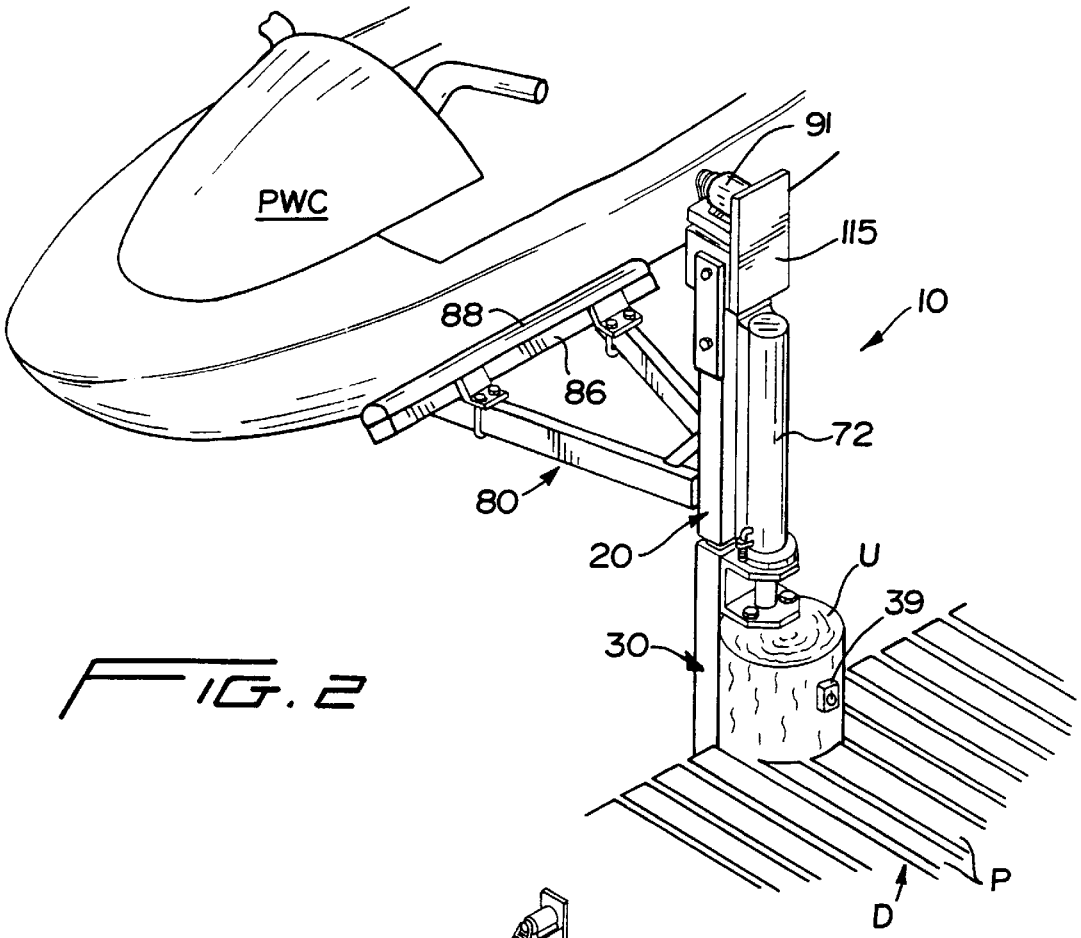
FIG. 2 is a perspective view of the lift, and illustrates the position of the platform and the personal watercraft supported thereby incident to being lowered into a body of water.
Figure 3:
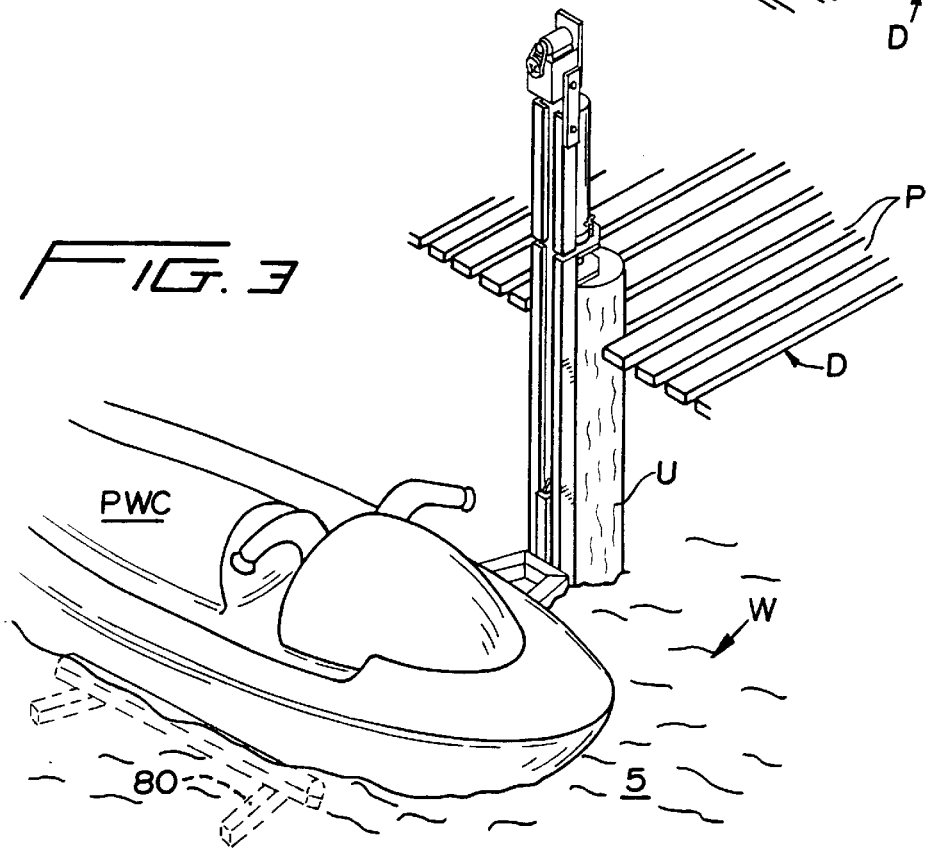
FIG. 3 is a perspective view, and illustrates the platform and the watercraft in a lowered position.
Figure 4:
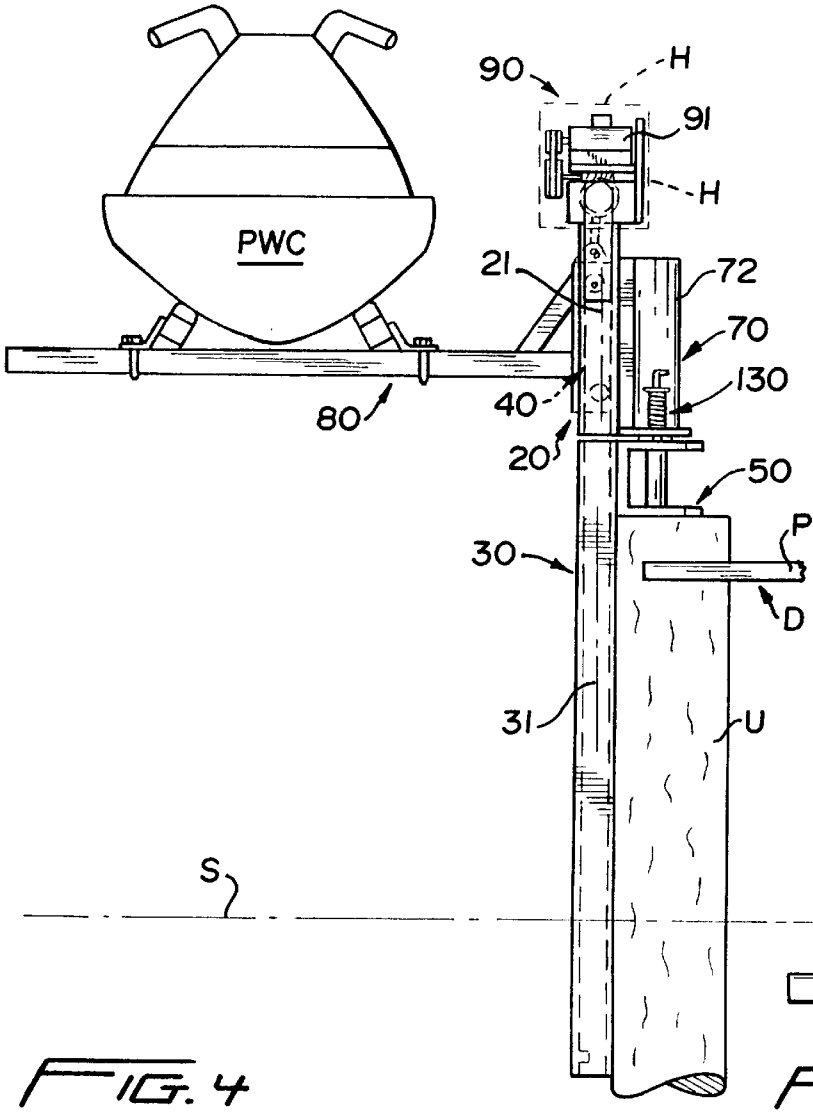
FIG. 4 is a side elevational view corresponding to FIG. 2, and illustrates an elevated position of the watercraft platform.

The lift 10 is associated with a body of water W having an upper surface S (FIGS. 3 through 5) and operates to elevate and lower the personal watercraft PWC between the positions shown in FIG. 2, 4 and 3, 5, as well as effect rotation to move the watercraft PWC between the positions shown in FIGS. 2 and 4 overlying the surface S of the water W and a position 180° removed therefrom (FIG. 1) in overlying relationship to planks P of a berth, deck, dock, or walkway D or the like adjacent the body of water W. The dock D may include one or more piles, pilings or upright supports U.

Figure 8:
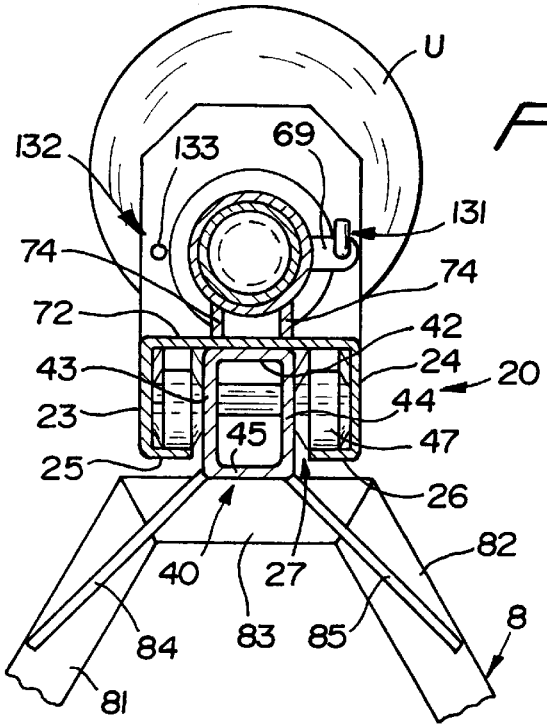
FIG. 8 is a cross-sectional view taken generally along line 8—8 of FIG. 6, and illustrates the manner in which guide rollers carried by the carriage cooperate with the C-shaped transverse cross-sectional configuration of the upper and lower elongated members.

The watercraft lift 10 includes an upper elongated metal channel member 20 and a lower elongated metal channel member 30 having respective longitudinal axes 21, 31. The upper and lower elongated channel members 20, 30, respectively, are of identical C-shaped cross-sections, as is best illustrated in FIG. 8 with respect to the upper elongated channel member 20. Referring specifically to FIG. 8, the upper elongated channel member 20 includes a bight or bight wall 22, opposite generally parallel side walls 23, 24 and opposing flanges 25, 26 defining therebetween an elongated slot 27.

The lower elongated channel member 30 includes a substantially identical bight wall 32 (FIG. 6), side walls 33, 34 in generally parallel relationship to each other and opposing spaced flanges 35, 36 defining a slot 37 therebetween. When the axes 21, 31 of the respective upper and lower elongated channel members 20, 30 are aligned (FIGS. 2 through 7) so too are the respective slots 27, 37 which permits carriage means in the form of a carriage 40 to travel therebetween, as will be described more fully hereinafter.

Figures 6, 7:
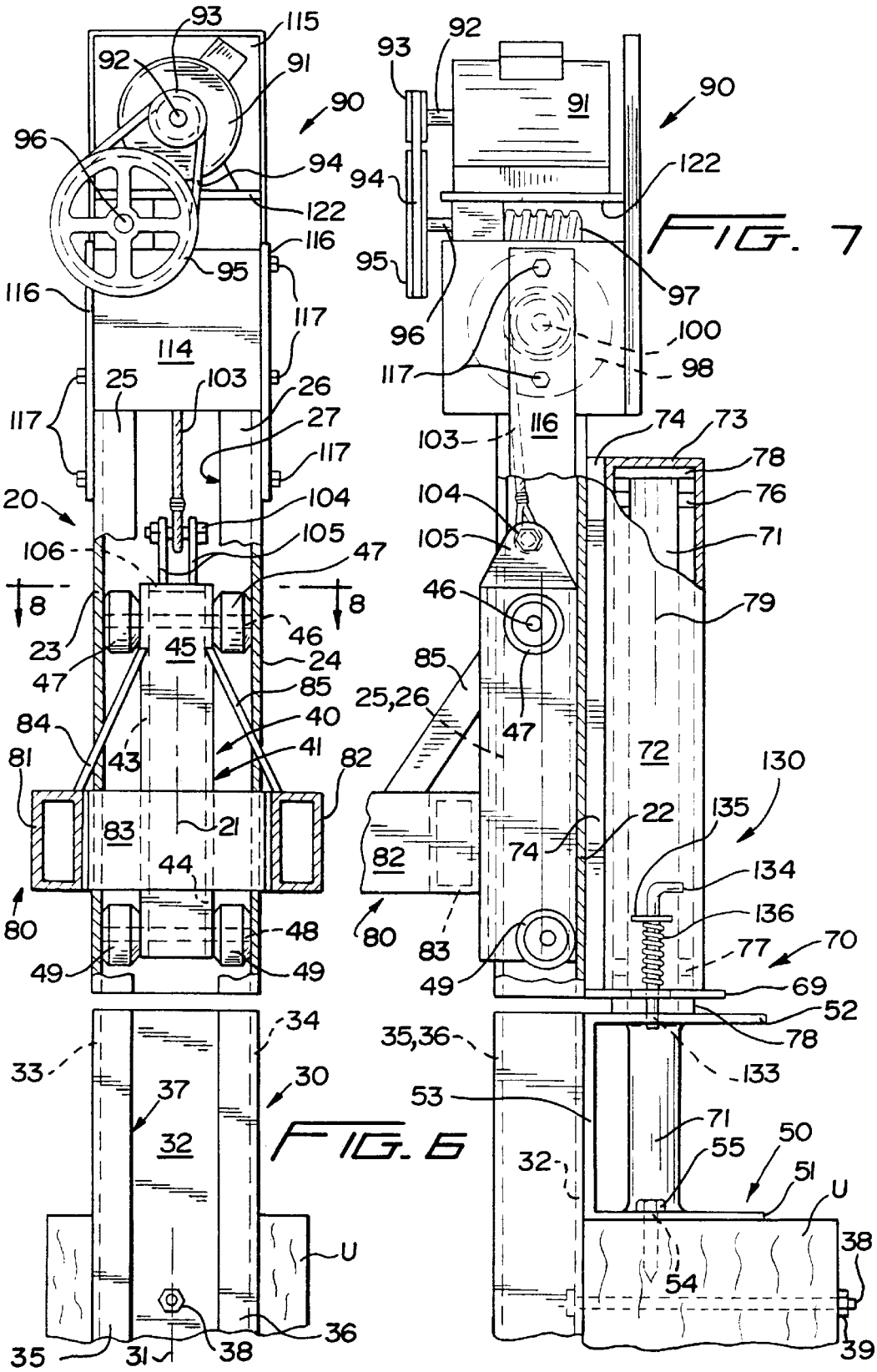
FIG. 6 is an enlarged fragmentary front elevational view, partially in cross-section, of the watercraft lift, and illustrates aligned upper and lower elongated members, a carriage located substantially within the upper elongated member, and a cable connected to the carriage for elevating and lowering the same through an associated reversible electric motor, meshed gears, drive belt and pulleys.
FIG. 7 is a side elevational view with parts broken away for clarity looking from right-to-left in FIG. 6, and further illustrates the connection of the cable to a reel, a meshed worm and wheel drive, and a journal for rotating the upper elongated member, the carriage when located therein and the watercraft platform about a vertical axis between the positions illustrated in FIGS. 1 and 2 of the drawings, and in each of which the upper elongated member can be locked relative to the lower elongated member to prevent rotation therebetween.

The lower elongated channel member 30 is located in vertical aligned relationship to the pile U, and the bight wall 32 thereof includes a plurality of vertical spaced openings (unnumbered) through which bolts 38 pass along the length thereof and are secured by nuts 39 (FIGS. 2 and 7) to rigidly secure the lower elongated channel member 30 to the pile U with, of course, the slot 37 opening away from the dock D, as is most evident in FIGS. 1, 3 and 6 of the drawings.

Figure 10:
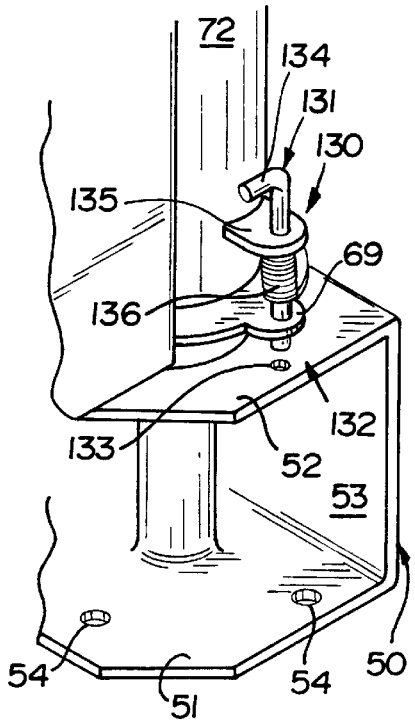
FIG. 10 is a perspective view, and illustrates a male locking member retracted from a female locking member (opening) to permit relative rotation between the upper and lower elongated members about a vertical axis.

A generally C-shaped metallic bracket 50 (FIGS. 7 and 10) is defined by a lower leg 51 parallel to an upper leg 52 and a bight wall 53 therebetween. The bight wall 53 is welded to the lower elongated channel member 30 and the lower leg 51 rests upon the pile U. The C-shaped bracket 50 not only offers rigidity to and between the lower elongated channel member 30 and the pile U, but additionally provides a supporting base for means 70 to be described hereinafter which effects rotation of the upper elongated channel member 20 relative to the lower elongated channel member 30 between the positions shown in FIGS. 1 and 2 of the drawings.

The carriage 40 is a hollow tubular metallic member 41 of a polygonal or rectangular cross-sectional configuration, as is best illustrated in FIG. 8 of the drawings, and is defined by a rear wall 42, side walls 43, 44 and a front wall 45. The tubular member 41 fits between and is slightly spaced from the flanges 25, 26 and 35, 36 and thereby can move relatively freely in and between the slots 27, 37. An upper shaft 46 passes through and is fixed to the tubular member 41 and carries opposite guide rolls or rollers 47 while a lower shaft 48 passes through and is fixed to the tubular member 41 and carries opposite guide rolls or rollers 49. The axes (unnumbered) of the shafts 46, 48 are offset relative to a vertical plane, as is most evident in FIG. 7 of the drawings which, in conjunction with a cantilevered watercraft support or platform 80 carried by the carriage 40 and the weight of the personal watercraft PWC supported thereupon, maintains the lower guide rollers 49 in rolling contact with the bight walls 22, 32, while the upper guide rolls 47 are in rolling contact with the flanges 25, 26 and 35, 36 of the respective upper and lower elongated channel members 20, 30.

The cantilevered support or platform 80 is disposed in a generally horizontal plane and is defined by tubular steel of a hollow polygonal cross-sectional configuration, such as that of the carriage 40 (FIG. 8). Ends (unnumbered) of metallic tubular members 81, 82 of the platform 80 converge toward the carriage 40 and are welded to a short metallic tube 83 which is in turn welded to the wall 45 of the tubular member 41 of the carriage 40. Angularly oriented metallic braces 84, 85 are welded at opposite ends to the tubular member 41 of the carriage 40 and to the respective tubular members 81, 82 of the platform 80. The braces 84, 85 may be omitted if desired for relatively low weight lifting. Conventional rails or bunks 86, 87 (FIG. 1) are conventionally adjustably secured in substantially parallel relationship to each other and in spanning relationship between the members 81, 82. The bunks or rails 86, 87 carry strips of soft non-marring material 88, 89 of conventional construction, such as carpeting, soft foam plastic or the like to prevent damage to the hull (unnumbered) of the personal watercraft PWC.

Figure 9:
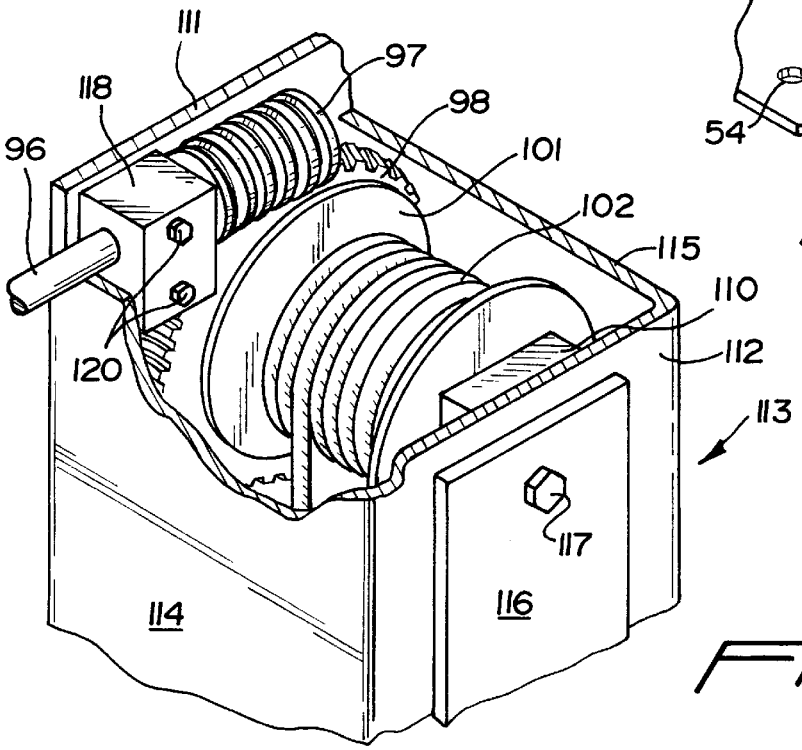
FIG. 9 is an enlarged fragmentary view of a housing at an upper end portion of the upper elongated member, and illustrates details of the cable, reel and meshed worm and wheel drive.

The carriage 40 is elevated and lowered through powered means, generally designated by the reference numeral 90, which includes a reversible electric motor 91 having an output shaft 92 to which is connected a sheave or pulley 93. A pulley belt 94 is entrained about the sheave or pulley 93 and about another sheave or pulley 95 carried by a shaft 96 which also carries a worm wheel 97 which meshes with a gear wheel 98 (FIG. 9). The gear wheel 98 is fixed to a shaft 100 to which is fixed a reel 101 about which is entrained a cable 102. The cable 102 includes a looped end 103 (FIGS. 6 and 7) entrained about a bolt 104 conventionally fixed between a pair of spaced flanges 105 which are welded to a plate 106 in turn welded to the walls 42 through 45 of the tubular member 41 of the carriage 40.

The shaft 100 is journalled for rotation in conventional journal blocks 110 of which only one is illustrated in FIG. 9 conventionally mounted at opposite walls 111, 112 of an upper housing 113 which includes additional walls 114, 115. Elongated steel mounting plates 116 fasten the housing 113 to an upper end portion (unnumbered) of the upper elongated channel member 20 through the utilization of conventional bolts and nuts 117 (FIGS. 6 and 9). The shaft 96 is journalled in a conventional journal block 118 which is in turn fastened by conventional bolts 120 to the wall 111. A horizontal plate 122 is welded to the walls 111, 112, 114, 115 (FIG. 6) and the motor 91 is conventionally bolted thereto. A hollow polymeric/copolymeric housing H open only at its bottom is shown in phantom outline in FIGS. 4 through 7 and is slipped over and entirely covers all of the components of the power means 90 and the housing means 113 to protect the same from the environment. Suitable fasteners (not shown) may be utilized to secure the housing H to the plate 115, for example.

The means 70 for effecting rotation of the upper elongated channel member 20 relative to the lower elongated channel member 30 includes a shaft 71 having a lower end welded to the leg 51 of the C-shaped bracket 50 (FIG. 7). The shaft 71 passes through a circular opening (unnumbered) in the upper leg 52 of the C-shaped bracket 50 and projects into a downwardly opening metal tube 72 which is open at its lower end and is closed by a plastic cap 73 at its upper end. The tube 72 is welded to each of a pair of vertically disposed steel plates 74 which are in turn also welded to the bight wall 22 of the upper elongated channel member 20, as is best illustrated in FIG. 8. An upper journal or bearing 76 and a lower journal or bearing 77 are in external relationship to the shaft 71 and in internal relationship to the tube 72 to thereby support the tube 72 for rotation about a vertical axis 79 of the tube 72 and the shaft 71 (FIG. 7). If found necessary or desirable, a conventional thrust bearing 78 can be located atop the shaft 71 and/or between a leg 52 of the C-shaped bracket 50 (FIG. 7) and an underlying horizontal flange 69 welded to the tube 72.

When the carriage 40 is housed entirely within the upper elongated channel member 20, as is illustrated in FIGS. 1, 2, 6 and 7, the upper elongated channel member 20, the support or platform 80 and the watercraft PWC carried by the latter can be swung about the vertical axis 79 between the positions illustrated in FIGS. 1 and 2 of the drawings for obvious purposes, namely, subsequent lowering and lifting and loading, unloading, maintenance, etc.

Figure 5:
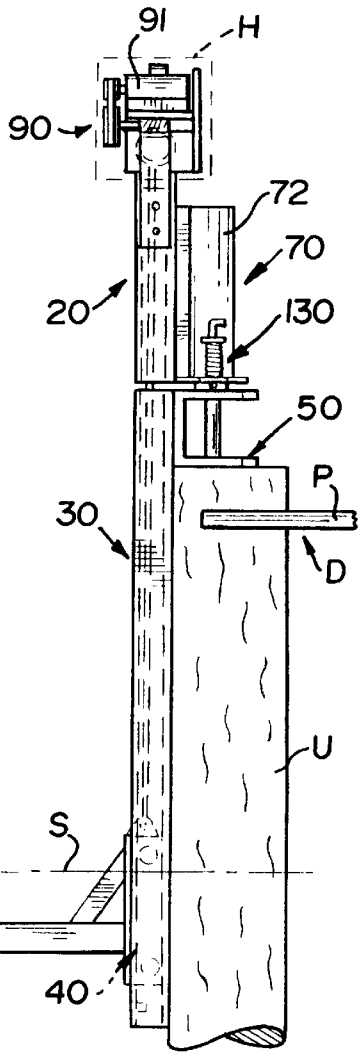
FIG. 5 is a side elevational view corresponding to FIG. 3, and illustrates a lowered position of the watercraft platform.

Means generally designated by the reference 130 (FIGS. 7 and 10) are provided for locking the upper and lower elongated channel members 20, 30, respectively, in two different positions offset 180° from each other, namely, each position in which the axes 21, 31 are in alignment (FIGS. 2 through 7 of the drawings) and the position shown in FIG. 1 in which the axes 21, 31 are in parallel but offset relationship to each other. The locking means 130 includes a male locking mechanism 131 and a female locking mechanism or member 132 in the form of diametrically opposite holes or openings 133 in the flange 52 of the C-shaped bracket 50. The male locking mechanism 131 includes a male locking member 134 which is slidably carried by the flange 69 and a bracket 135 welded to the tube 72. A spring 136 normally biases the male locking member 134 into either of the openings or holes 133. For example, in FIG. 7, the male locking member 132 is biased by the spring 136 into the illustrated female locking member or hole 133 to prevent relative rotation and maintain the upper and lower elongated channel members 20, 30, respectively, with the axes 21, 31 thereof in alignment. In this position, the electric motor 91 can be energized selectively in either direction of rotation to raise or lower the carriage 40, the platform 80 and the personal watercraft PWC associated therewith. In order to achieve rotation of the upper elongated channel member 20 relative to the lower elongated channel member 30 to rotate, for example, the carriage 80 from the position shown in FIG. 2 to that shown in FIG. 1, the male locking member 134 is grasped, pulled upwardly (FIG. 10), releasing the same from the female locking aperture 133. The upper elongated channel member 20, carriage 80 and personal watercraft PWC can now be manually rotated about the axis 79 to the position shown in FIG. 1 at which point the male locking member 134 will be biased by the spring 134 into the diametrically opposite hole 133 locking the lift 10 in the position shown in FIG. 1. In this figure, a personal watercraft can be placed upon the bunks, removed therefrom, maintenance performed in the latter position, etc., and thereafter the male locking member 134 can again be pulled upwardly against the bias of the spring 134, carriage 80 and the upper elongated channel member 20 swung back to the positions shown in FIGS. 2 and 4, and male locking member 134 again being released to the locked position (FIGS. 4 and 5). In FIG. 4, for example, the motor 91 can be energized to appropriately rotate the power means associated therewith to unreel the cable 102 during which time the carriage 40 will descend from the position shown in FIGS. 4, 6 and 7 into and toward the lower end portion (unnumbered) of the lower elongated channel member 30 to the position shown in FIGS. 3 and 5. The latter position of the watercraft PWC approximates the point at which the watercraft PWC will float and, thus, can be powered from or backed upon the rails 86, 87, although the carriage 40 can descend further so that the watercraft PWC is totally released from all contact with the platform 80, specifically the members 88, 89 thereof.

An important feature of the invention resides in the fact that the upper leg 52 of the bracket 50 projects well beyond the carriage 40 when the upper channel member 20 is in the position shown in FIG. 1. Thus, should the cable 102 inadvertently break or the carriage 40 inadvertently drop for any reason, the lower edge (unnumbered) of the carriage 40 will contact and rest upon the upper leg 52. Thus, the carriage 40, the support 80 and the personal watercraft PWC cannot drop an inordinate distance to become damaged or to cause damage.

Although a preferred embodiment of the invention has been specifically illustrated and described herein, it is to be understood that minor variations may be made in the apparatus without departing from the spirit and scope of the invention, as defined the appended claims.

We claim:

1. A lift particularly adapted to selectively elevate and lower an object and effect rotational displacement of the object in an elevated position comprising an upper elongated member and a lower elongated member, said upper elongated member being located above said lower elongated member with a lower end portion of said upper elongated member being adjacent an upper end portion of said lower elongated member, said upper and lower elongated members each having a longitudinal axis, said longitudinal axes being substantially aligned in a first position of said upper and lower elongated members and being in substantially offset parallel relationship in a second position of said upper and lower elongated members, a carriage carrying means for supporting an object; said carriage being slidable along said upper and lower end portions between a first upper position carried by said upper elongated member, a second lower position carried by said lower elongated member and a medial position spanning said upper and lower elongated members; and means for effecting relative rotation of said upper and lower elongated members about a substantially vertical axis when said carriage is in said first position whereby an object supported by said supporting means can be rotatably displaced between at least first and second arcuately spaced locations.

2. The lift as defined in claim 1 including means for locking said upper and lower elongated members in said first position thereof with said longitudinal axes substantially aligned.

3. The lift as defined in claim 1 including means for locking said upper and lower elongated members in said second position thereof with said longitudinal axes in substantially offset parallel relationship.

4. The lift as defined in claim 1 including means for locking said upper and lower elongated members selectively in said first and second positions thereof in which said longitudinal axes are respectively substantially aligned and are in substantially offset parallel relationship.

5. The lift as defined in claim 1 including means for locking said upper and lower elongated members in said first position thereof with said longitudinal axes substantially aligned, and said locking means include a male locking member of one of said upper and lower elongated member selectively received in a female locking member of another of said upper and lower elongated members.

6. The lift as defined in claim 1 including means for locking said upper and lower elongated members in said second position thereof with said longitudinal axes in substantially offset parallel relationship, and said locking means include a male locking member of one of said upper and lower elongated member selectively received in a female locking member of another of said upper and lower elongated members.

7. The lift as defined in claim 1 including means for locking said upper and lower elongated members selectively in said first and second positions thereof in which said longitudinal axes are respectively substantially aligned and are in substantially offset parallel relationship, and said locking means include a male locking member of one of said upper and lower elongated member selectively received in a one of at least two female locking members of another of said upper and lower elongated members.

8. The lift as defined in claim 1 including a reel carrying a cable having an end connected to said carriage, power means for imparting rotation to said reel, and means for mounting said reel and power means to said upper elongated member.

9. The lift as defined in claim 1 including a reel carrying a cable having an end connected to said carriage, power means for imparting rotation to said reel, means for mounting said reel and power means to said upper elongated member, said carriage being slidable substantially within said upper elongated member, and a portion of said cable between said reel and said carriage being located in said upper elongated member.

10. The lift as defined in claim 1 including a reel carrying a cable having an end connected to said carriage, power means for imparting rotation to said reel, and means for mounting said reel and power means to an upper end portion of said upper elongated member.

11. The lift as defined in claim 1 including a reel carrying a cable having an end connected to said carriage, power means for imparting rotation to said reel, and means for mounting said reel and power means atop said upper elongated member.

12. The lift as defined in claim 1 wherein said upper and lower end portions of the respective lower and upper elongated members have substantially similar transverse cross-sections.

13. The lift as defined in claim 1 wherein said upper and lower end portions of the respective lower and upper elongated members have substantially similar hollow transverse cross-sections.

14. The lift as defined in claim 1 wherein said upper and lower end portions of the respective lower and upper elongated members have substantially similar C-shaped transverse cross-sections.

15. The lift as defined in claim 1 wherein said upper and lower end portions of the respective lower and upper elongated members have substantially similar hollow C-shaped transverse cross-sections.

16. The lift as defined in claim 1 wherein said upper and lower end portions of the respective lower and upper elongated members are generally hollow and have substantially similar transverse cross-sections, and said carriage is substantially entirely housed for guiding travel in and between said upper and lower end portions.

17. The lift as defined in claim 1 wherein said upper and lower end portions of the respective lower and upper elongated members are generally hollow and have substantially similar transverse cross-sections, said carriage is substantially entirely housed for guiding travel in and between said upper and lower end portions, said upper and lower end portions are generally C-shaped in transverse cross-section and each includes substantially spaced opposing flanges defining respective upper and lower slots, and said carriage is slidable within said upper and lower end portions.

18. The lift as defined in claim 1 wherein said upper and lower end portions of the respective lower and upper elongated members are generally hollow and have substantially similar transverse cross-sections, said carriage is substantially entirely housed for guiding travel in and between said upper and lower end portions, said upper and lower end portions are generally C-shaped in transverse cross-section and each includes substantially spaced opposing flanges defining respective upper and lower slots, said carriage is slidable within said upper and lower end portions, and said object supporting means includes a portion projecting selectively through said slots.

19. The lift as defined in claim 1 wherein said upper and lower end portions of the respective lower and upper elongated members are generally hollow and have substantially similar transverse cross-sections, said carriage is substantially entirely housed for guiding travel in and between said upper and lower end portions, said upper and lower end portions are generally C-shaped in transverse cross-section and each includes substantially spaced opposing flanges defining respective upper and lower slots, said carriage is slidable within said upper and lower end portions, said upper and lower end portions C-shaped cross-sections each being further defined by a bight wall and opposite parallel side walls each merging with a flange, said carriage having upper and lower end portions carrying upper and lower rollers, said upper and lower roller having axes disposed on opposite sides of a longitudinal axis of said carriage, and said upper and lower rollers ride along said bight walls and flanges respectively.

20. The lift as defined in claim 1 wherein said upper and lower end portions of the respective lower and upper elongated members are generally hollow and have substantially similar transverse cross-sections, said carriage is substantially entirely housed for guiding travel in and between said upper and lower end portions, a reel carrying a cable having an end connected to said carriage, power means for imparting rotation to said reel, means for mounting said reel and power means to said upper elongated member, and a portion of said cable between said reel and said carriage being located in said upper elongated member.

21. The lift as defined in claim 1 including means for preventing said carriage from accidentally descending a predetermined distance when said upper and lower elongated members are in said second position.

22. The lift as defined in claim 1 wherein said rotation effecting means includes a relatively rotatable shaft and journal, said shaft being carried by one of said upper and lower elongated members, and said journal being carried by the other of said upper and lower elongated members.

23. The lift as defined in claim 1 wherein said rotation effecting means includes a relatively rotatable shaft and journal, said shaft being carried by said lower elongated member, and said journal being carried by said upper elongated member.

24. The lift as defined in claim 2 including a reel carrying a cable having an end connected to said carriage, power means for imparting rotation to said reel, and means for mounting said reel and power means to said upper elongated member.

25. The lift as defined in claim 2 including a reel carrying a cable having an end connected to said carriage, power means for imparting rotation to said reel, means for mounting said reel and power means to said upper elongated member, said carriage being slidable substantially within said upper elongated member, and a portion of said cable between said reel and said carriage being located in said upper elongated member.

26. The lift as defined in claim 2 wherein said rotation effecting means includes a relatively rotatable shaft and journal, said shaft being carried by one of said upper and lower elongated members, and said journal being carried by the other of said upper and lower elongated members.

27. The lift as defined in claim 24 including a reel carrying a cable having an end connected to said carriage, power means for imparting rotation to said reel, means for mounting said reel and power means to said upper elongated member, said carriage being slidable substantially within said upper elongated member, and a portion of said cable between said reel and said carriage being located in said upper elongated member.

28. The lift as defined in claim 24 wherein said rotation effecting means includes a relatively rotatable shaft and journal, said shaft being carried by one of said upper and lower elongated members, and said journal being carried by the other of said upper and lower elongated members.

29. The lift as defined in claim 27 wherein said rotation effecting means includes a relatively rotatable shaft and journal, said shaft being carried by one of said upper and lower elongated members, and said journal being carried by the other of said upper and lower elongated members.

* * * * *